United States Patent [19]

Benisek

[11] 3,954,402

[45] May 4, 1976

[54] TEXTILE TREATMENT

[75] Inventor: Ladislav Benisek, Ilkley, England

[73] Assignee: I.W.S. Nominee Company Limited, London, England

[22] Filed: May 3, 1974

[21] Appl. No.: 466,916

[30] Foreign Application Priority Data

May 15, 1973 United Kingdom ..... 23119/73

[52] U.S. Cl. ..... 8/128 R; 8/31

[51] Int. Cl.[2] ..... D06M 3/02

[58] Field of Search ..... 117/138; 8/17, 31, 96, 8/128

[56] References Cited

UNITED STATES PATENTS

| | | | |
|---|---|---|---|
| 1,694,562 | 12/1928 | Rabe et al. | 8/31 |
| 1,807,208 | 5/1931 | Hankey | 8/17 |
| 1,852,998 | 4/1932 | Ellis | 117/137 |

OTHER PUBLICATIONS

German Offleniegunsshrift, No. 2,152,196, Apr. 27, 1972.

Chem. Abst., 36: 660[9].

Chem. Abst., 57: 15,351i.

Chem. Abst., 65: 4027f.

*Primary Examiner*—Theodore Morris

*Attorney, Agent, or Firm*—Dennis P. Clarke

[57] ABSTRACT

Flame resistance of polyamide materials, notably wool and other keratinous materials, is enhanced by application of tungsten from acid solutions of anionic tungsten complexes. Still more effective treatment is obtained by simultaneously applying anionic complexes of zirconium or titanium. The complexes can be applied by exhaustion from a bath, preferably below pH 3.5 and at temperatures from 30° to 100°C. Dyes can be simultaneously applied from the same bath. Textiles can be padded in the solution and dried. The complexes may be isopolytungstates or heteropolytungstates and may be prepared with the help of organic carboxylic or hydroxycarboxylic acids.

8 Claims, No Drawings

TEXTILE TREATMENT

The present invention relates to the improvement of the flame resistance of polyamide materials, including natural polyamide fibres and leather.

Naturally occurring polyamide fibres, for example the wool of sheep, display a high degree of natural flame retardancy because of their relatively high nitrogen and moisture content, high ignition temperature (570° – 600°C), low heat of combustion, low flame temperature and high limiting oxygen index.

The performance of wool fabrics in the various test methods currently in use depends on the specified test method and fabric construction. A horizontal test method is much less severe than a 45° or a vertical test. Most wool fabrics will pass a horizontal test but may not pass some 45° or vertical tests. The influence of fabric construction is also very important; the denser and heavier the fabric the lower the flammability.

It follows that wool in some cases needs a flame-resist treatment in order to pass a particular flammability specification and test method.

In my co-pending patent application Ser. No. 235,866, filed Mar. 17, 1972, there is described a flame-resist treatment in which wool is treated with an anionic zirconium complex. My co-pending application Ser. No. 190,665, filed Oct. 19, 1971, now U.S. Pat. No. 3,857,727 describes a similar process using titanium complexes.

The flame-resist treatments disclosed in my above-mentioned patent applications are based on the exhaustion of anionic fluoro-, carboxylato- and hydroxycarboxylato-zirconate or -titanate complexes onto the wool fibre. These treatments are sufficiently effective to flame-resist the majority of all-wool textiles to meet a particular flammability specification.

However, there are some cases where the treatments are not sufficiently effective, namely in the case of resintreated wool, wool-rich blends containing less than 90% of wool and wool dyed with phthalocyanine dyes.

According to the present invention there is provided a process for improving the flame resistance of polyamide materials which comprises treating the fibres under acid conditions with an anionic complex of tungsten.

It has also been found according to a further aspect of this invention, that by the addition of anionic tungstate complexes to fluoro-, carboxylato-, and hydrocarboxylatozirconates and -titanates the flame-resist effect is significantly improved. Further, the improved treatments have a considerably improved fastness to alkalis and washing.

Suitable tungsten complexes are isopolytungstates and heteropolytungstates. Isopolytungstates are formed in aqueous solutions of tungstates by decreasing the pH. Thus a simple tungstate can be converted into various paratungstates and metatungstates:

$$\underset{\text{tungstate}}{WO_4^{2-}} \xrightarrow{pH\ 6} \underset{\text{paratungstate}}{HW_6O_{21}^{5-}} \xrightarrow{pH\ 5} \underset{\text{paratungstate}}{W_{12}O_{41}^{10-}} \xrightarrow{pH\ 3} \underset{\text{metatungstate}}{W_{12}O_{39}^{6-}}$$

Heteropolytungstates are formed when tungstate solutions containing other inorganic or organic anions or metal ions are acidified. A typical formula for heteropolytungstates is:

$$[x^{n+}\ W_{12}\ O_{40}\ ]\ (8-n)-$$

where X is P, As, Si, Sn, Ti, Zr, B, Mn, Al, Fe, Cr, Co, Ni or Cu.

A special case of heteropolytungstates are complexes of tungstates with carboxylic (e.g. oxalic acid) and hydroxycarboxylic acids (e.g. citric, tartaric acid).

Any of the above-mentioned tungstate complexes is flameretardant if it is applied to wool in an anionic form from a solution with a pH less than 3.5, preferably less than 3, and a temperature of at least 30°C, but preferably 60°C, for at least 10 minutes. The flame-resist effect is significantly improved if the anionic tungstate complex is applied to wool simultaneously with an anionic zirconium or titanium complex in acid conditions (e.g. pH 3) at a temperature of at least 30°C for a time of at least 10 minutes.

The tungstate complexes are available commercially (e.g. phosphotungstic acid) or they may be formed in situ by dissolving sodium tungstate in water and then adding sufficient acid (formation of isopolytungstates), or phosphoric, boric, citric, oxalic or citric acid (formation of heteropolytungstates).

The use of heteropolytungstates is preferred as they have a very good fastness to light when exhausted onto the wool fibre. Some isopolytungstates when applied to wool cause severe discoloration when exposed to ultraviolet light. Although this discoloration is reversible, that is it gradually disappears when the source of u.v. light is removed, it could alter the shade of undyed wool and wool dyed to light shades, when exposed to light. However, for certain applications, or dark shades, this may not be important.

The tungstate complexes can be applied by exhaustion using conventional machinery for dyeing textiles (for example dollies, winches, beam dyeing equipment, hank dyeing machinery or package dyeing machinery) or by padding or spraying.

The treatment may be applied to the fibres at any desired state during textile processing although it will normally be used in textile finishing.

To obtain the best flame-resist effect which is most stable to washing, it is desirable to comply with the following conditions, which help to achieve successful exhaustion and reaction of the tungstate complex with the wool fibre:

1. The tungsten should be present in solution as an anion.
2. The pH of the treating bath should be below 3.5. It is believed that this charges the amino groups of the wool fibres positively. These positively charged amino groups will attract the negatively charged tungstate complexes.
3. The application of the anionic tungstate complexes has to be carried out at a certain minimum temperature (30°C) and for a certain minimum time (10 mins.) to obtain good exhaustion and fixation of the tungstate complex with the wool fibre.

If one of these conditions is omitted the flame-resist treatment may not be entirely successful.

The tungstate treatment may be carried out simultaneously with dyeing, using dyes which exhaust with level results at low pH values (e.g. acid levelling and 1:1 premetallised dyes). The mechanical properties of wool treated with tungstate complexes are very similar to the properties of wool dyed with acid dyes.

Although the treatment of the invention is particularly suited to wool it may be used with other keratinous or polyamide materials, such as alpaca, silk, cashmere, mohair, leather or natural hair. In this latter case the treatment may be useful for the flame-proofing of wigs.

The tungsten complex may be added directly to the treatment liquor or it may be formed in situ. When it is to be formed in situ an alkali metal tungstate may be added to the acidified liquor. Under these acid conditions a polytungstate is formed and, if a further reactive substance such as a carboxylic or hydroxy-carboxylic acid is present, a heteropolytungstate will be formed. Aqueous sodium tungstate, for example, by itself has a pH of 8 or 9 which is far too high for the successful performance of the process.

The low pH may be produced by one of the reactants, or may be produced by adding an acid such as formic acid or a mineral acid.

The invention provides a flame-resist treatment in its own right, but when used in conjunction with the titanium or zirconium treatment described in the aforementioned applications there is a marked improvement in the flame-resist properties. The treatments with tungsten and titanium or zirconium appear to have a synergistic or catalytic effect upon one another, as the effect of the combined treatment is far greater than would be expected.

We have carried out tests and have ascertained that when wool is treated with potassium fluorozirconate, at 70°C and pH 2.5, about 75 percent of the fluorozirconate is exhausted onto the wool. If the test is now repeated with the addition of an isopolytungstate or heteropolytungstate to the bath, the exhaustion of the anionic zirconium complex onto the fibre is increased to about 95 percent and the tungsten complex is also about 95 percent exhausted onto the fibre. Thus the effect of the combined treatment is far greater than would be expected using either the zirconium treatment or the tungsten treatment alone.

As already mentioned, the previously proposed treatments with zirconium or titanium are entirely adequate for most purposes, but combined treatment with tungsten and titanium or zirconium is particularly advantageous in the following cases.

Wool is often treated with various resins in order to modify or improve its properties. Resin treatments may be provided to confer properties such as shrink-resistance, dimensional stability, permanent press, soil retardancy and water repellancy. Such resins include polythiols such as "Oligan," isocyanates and blocked isocyanates such as "Synthappret LKF," aliphatic polyamine-epichlorohydrin resins such as "Hercosett," acrylics, polybutadienes and silicones. Most of these tend to make the wool more flammable and, even when given a flame-proofing treatment, resin-treated wool may fail some flame tests. However, when resin-treated wool is given the preferred combined zirconium or titanium and tungsten treatment of the invention excellent flame-resistance is conferred.

Either of the titanium and zirconium processes alone will usually confer flame-resist properties on blends containing at least 85% wool, but most other fibres are more flammable than wool and increase the flammability of the blend. However, the combined tungsten/-titanium or zirconium process will impart adequate flame-resistance to blends containing as little as 50 or 60% wool. Important examples of such blends are 65/35 wool/polyester, 70/30 wool/nylon and 80/20 wool/polyester.

With certain all-wool fabrics, e.g. those with a very open construction or low-density long pile carpets or rugs, it has been difficult to meet the most stringent flame test, even after flame-resist treatments. However, the preferred combined treatment of this invention will adequately flame-proof such fabrics. Similarly fabrics which require an alkaline after-treatment, e.g. to restore the original shade to phthalocyanine dyes, can also be effectively flame-proofed by the preferred combined process, whereas with a titanium or zirconium treatment alone the alkaline treatment significantly reduces the flame-resist effect.

The amount of tungsten taken up by the polyamide material can vary widely, but in general it is preferred to apply from ½ to 10 percent of tungsten by weight of the polyamide material, where the temperature complex is used alone. More preferably, levels of 5–6 percent are used.

When the tungsten complex is being used in combination with an anionic complex of zirconium or titanium, the preferred levels are from ½ to 6% tungsten, especially about 3 percent; from 2 to 10% zirconium, especially about 8 percent; and from 1 to 5% titanium, especially about 4 percent. The ratios W:Zr of about 3:8 and W:Ti of about 3:4 are particularly preferred on account of the particularly effective exhaustion achieved.

The upper limits of concentration are not critical, but little additional effect is achieved by using levels in excess of these limits. Moreover, excessive quantities of these metals can give rise to alterations in the handling qualities of the materials.

The invention will be illustrated further, by way of example only, with reference to the following Examples.

EXAMPLE I

A wool carpet yarn dyed with phthalocyanine dye (Cibacrolan Blue 8G) was treated in hank form at pH 2.6, for 30 mins. at 60°C, in a bath containing the following:

5% potassium fluorozirconate on weight of wool (oww)
3% sodium tungstate oww
1% boric acid oww
10% hydrochloric acid (37%) oww followed by one rinse with water.

After treatment the wool had a green shade instead of the original blue shade because of the low pH of the treating bath. An aftertreatment with 14% sodium bicarbonate oww for 20 minutes at 40°C restored the original shade. A shag pile carpet made from the treated yarn easily passed the American Tablet Test Standard DOC FF 1-70 with a char length of 2.5 cm. When the same yarn was treated without the addition of sodium tungstate the shag pile carpet failed the same standard test as the char length was 15 cm.

EXAMPLE II

This example illustrates the simultaneous treatment and dyeing of a single jersey all-round fabric shrink-resist treated with Synthappret LKF (Bayer).

The fabric was treated and dyed in a winch containing the following:

8% potassium fluorozirconate oww
3% sodium tungstate oww 0.3% phosphoric acid oww
1% boric acid oww
10% hydrochloric acid oww
2% Neopolar Yellow 4GL oww Treatment was at pH 2.7, starting at 30°C, bringing to the boil in 30 minutes, and boiling for 45 minutes, and was followed by one rinse with water.

Sodium tungstate and phosphoric acid were added as a predissolved mixture to the bath after the other chemicals.

The treated fabric was tested by a vertical flame test - Method 5902 Federal Specification CCC-T 19 lb 1951, with a 12 sec. ignition time. The burning time was 1 sec. and the char length 7 cm which easily met the required specification - maximum burning time 15 sec., maximum char length 20 cm. The same fabric treated without the addition of sodium tungstate failed the same specification as it burnt the entire length within 30 sec.

EXAMPLE III

An all-wool double jersey fabric shrink-proofed with Hercosett (Hercules) resin was flame-resist treated at pH 2.5, for 30 min. at 75°C, in a bath containing the following:

7% zirconium oxychloride oww
2% ammonium bifluoride oww
3% citric acid oww
5% sodium tungstate oww
7% hydrochloric acid oww followed by one rinse with water.

After being dried the treated fabric was tested by the vertical flame test described in Example II. The burning time was 0 sec. and char length 6 cm. After 20 washings at 40°C in a domestic washing machine the burning time was 1 sec. and char length 7.5 cm. When the same fabric was treated with the same recipe but without the addition of sodium tungstate it passed the vertical flame test before washing but failed after 5 washes at 40°C.

EXAMPLE IV

This example illustrates the effectiveness of the tungstate treatment without the addition of zirconium or titanium complexes.

An all-wool upholstery fabric was treated in a winch containing the following:

6% sodium tungstate oww
15% formic acid oww

Treatment was at pH 2.9, for 30 min. at 75°C, and was followed by one rinse with water.

The treated fabric easily met the required flammability standard described in Example II with a burning time of 2 sec. and char length of 9 cm.

EXAMPLE V

This example illustrates the flame-resist treatment of a wool-rich blend.

A woven fabric containing 65% wool and 35% polyester fibre was treated in a winch as in Example II, but the temperature of the treatment was kept at 75°C and no dye was applied.

The treated fabric passed the vertical flame test standard described in Example II. Without the addition of sodium tungstate the fabric failed the same flammability standard.

EXAMPLE VI

A 70/30 wool/nylon woven fabric was treated as in Example II but potassium fluorozirconate was replaced by 5% potassium fluorotitanate oww and the temperature during the treatment was kept at 70°C. The treated fabric passed the previously mentioned standard whereas without the addition of tungstate it did not.

EXAMPLE VII

This example illustrates a padding application of the tungstate treatment.

A solution containing the following ingredients was applied to an 80/20 wool/polyester woven fabric with a pick-up of 70% to provide the following levels of impregnation:

7% zirconium oxychloride oww
3% ammonium bifluoride oww
5% sodium tungstate oww
2% formic acid oww After being padded the fabric was dried at 110°C, rinsed in cold water in a winch to remove the residual chemicals and dried once again. In a slightly different experiment the fabric was batched at 20°C for 4 hours after padding and then rinsed and dried.

In both cases the fabric passed the vertical flame test described in Example II with a burning time of 2 sec. and a char length of 8 cm.

EXAMPLE VIII

This example illustrates the effectiveness of heteropolytungstates without the addition of zirconium or titanium complexes.

An all-wool blanket was treated in a winch containing the following:

4% citric acid oww
5% sodium tungstate oww
10% hydrochloric acid 37% oww

The liquor ratio was 1:25, pH 2.5, and the treatment 30 min. at 65°C, followed by one rinse with water. The treated fabric easily met the required standard described in Example II with a burning time of 0 sec. and char length of 4 cm.

EXAMPLE IX

An all-wool single jersey fabric shrink-proofed by the continuous Dylan GRC resin treatment (Precision Processes Ltd.) was flame-resist treated with the following:

7% zirconium oxychloride oww
2.5% ammonium bifluoride oww
2.5% citric acid oww
7% hydrochloric acid oww
3% sodium tungstate oww The liquor ratio was 1:15, pH 2.5, and the treatment 30 min. at 70°C, followed by one rinse with water.

The treated fabric easily met the requirements of the flammability standard described in Example II before, during and after 50 washes at 40°C. The shrink-resist treatment was not affected by the flame-resist treatment.

EXAMPLE X

An all-wool double jersey fabric shrink-resist treated by the batch Dylan GRB resin treatment (Precision Processes Ltd.) was flame-resist treated according to the procedure described in Example IX.

After the treatment the fabric met the flammability requirements described in Example II both before and after 50 washings. No adverse effect on the shrink-resistant properties was noticed.

EXAMPLE XI

This example shows the compatability of the zirconium-tungsten treatment with a silicone resin treatment. An all-wool woven fabric was flame-resist treated with the following:

10% potassium fluorozirconate oww
10% hydrochloric acid 37% oww
3% citric acid oww } premix
3% sodium tungstate oww The liquor ratio was 1:20, pH 2.5, and the treatment 30 min. at 65°C, followed by one rinse with water.

After being dried, part of the flame-resist treated fabric was shrink-resist treated in a commercial dry-cleaning machine with the DC 109 silicone finish (Dow Corning). The fabric both before and after the shrink-resist treatment met the flammability standard described in Example II with a burning time of 2 sec. and a char length of 6.5 cm. The felting shrinkage of the fabric which had not been shrink-resist treated was 25 percent while the shrink-resist treated sample showed a felting shrinkage of only 2 percent after 3 hours wash in a 15 1 washing machine (Cubex) at 40°C, pH .7.

EXAMPLE XII

The same fabric as in Example XI was first resin-treated with DC 109 followed by the flame-resist treatment described in Example XI. The flame-resist treated fabric had a burning time of 1 sec. and a char length of 7 cm, while a sample receiving the shrink-resist treatment only failed the flammability standard described in Example II.

EXAMPLE XIII

This example illustrates the flame-resist treatment of a wool-rich blend. A blanket containing 65% wool and 35% rayon was treated in a winch with the following:

9% potassium fluorozirconate oww
10% hydrochloric acid 37% oww
3% tartaric acid oww } premixed
3% sodium tungstate oww The liquor ratio was 1:25, pH 2.7, and the treatment 30 min. at 50°C, followed by one rinse with water.

The burning time of the treated blanket was 1 sec. and the char length 3 cm when tested by the vertical flame test described in Example II.

EXAMPLE XIV

An upholstery fabric containing 75% wool and 25% polyacrylic fibres was treated in a winch with the following:

4% fluorotitanic acid oww
5% hydrochloric acid oww
3% oxalic acid oww
3% sodium tungstate oww The liquor ratio was 1:30, pH 2.9, and the treatment 30 min. at 70°C, followed by one rinse with water.

The treated fabric met the flammability requirements described in Example II with a burning time of 4 sec. and char length of 9 cm.

Although in certain of the above Examples, where blends have been treated, the blends contained more than 50% wool, it will be appreciated that where non-flammable fibres such as asbestos, glass or "Nomex" form part of the blend, the proportion of wool may be reduced without impairing the flame-resist properties.

I claim:

1. A process of improving the flame resistance of keratinous textile material comprising the steps of:

preparing a solution containing an anionic complex of tungsten and at least one anionic complex of titanium or zirconium said complexing agent selected from the group consisting of fluro, carboxylato and hydroxycarboxylato groups and having a pH below 3.5;

and impregnating said material with said solution until a flame retardant quantity of said tungsten and titanium or zirconium is taken up by said material.

2. The process of claim 1 wherein said material is padded in said solution and dried.

3. The process of claim 1 wherein said material is at least 50% wool.

4. The process of claim 1 wherein the amount of said tungsten complex applied to said material is from ½ to 10% tungsten by weight of said Keratinous textile material.

5. The process of claim 1 wherein said material is immersed in said solution for at least 20 minutes at a temperature of from 30° to 100°C.

6. The process of claim 1 wherein said solution further contains a dye for said material.

7. The process of claim 1 wherein the step of preparing said solution includes the addition of an alkali metal tungstate to an acidified solution of an organic carboxylic or hydroxycarboxylic acid.

8. The process of claim 1 wherein the anionic complex of tungsten is selected from isopolytungstates and heteropolytungstates.

* * * * *